US011828539B2

(12) United States Patent
Inagaki et al.

(10) Patent No.: US 11,828,539 B2
(45) Date of Patent: Nov. 28, 2023

(54) HEAT PIPE

(71) Applicant: FURUKAWA ELECTRIC CO., LTD., Tokyo (JP)

(72) Inventors: Yoshikatsu Inagaki, Tokyo (JP); Hirofumi Aoki, Tokyo (JP); Kazuya Takahashi, Tokyo (JP); Shinichi Ito, Tokyo (JP); Shuta Hikichi, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/860,630

(22) Filed: Jul. 8, 2022

(65) Prior Publication Data

US 2022/0341681 A1 Oct. 27, 2022

Related U.S. Application Data

(63) Continuation of application No. 16/600,114, filed on Oct. 11, 2019, now Pat. No. 11,415,373, which is a continuation of application No. PCT/JP2018/015246, filed on Apr. 11, 2018.

(30) Foreign Application Priority Data

Apr. 12, 2017 (JP) ..... 2017-079261

(51) Int. Cl.
*F28D 15/04* (2006.01)
*B22F 5/10* (2006.01)

(52) U.S. Cl.
CPC ..... *F28D 15/046* (2013.01); *B22F 5/106* (2013.01); *F28F 2255/18* (2013.01)

(58) Field of Classification Search
CPC .... F28D 15/046; B22F 5/106; F28F 2265/18; H01L 23/427
See application file for complete search history.

(56) References Cited

U.S. PATENT DOCUMENTS

| | | | | |
|---|---|---|---|---|
| 3,754,594 | A | 8/1973 | Ferrell | |
| 4,274,479 | A | 6/1981 | Eastman | |
| 4,825,661 | A | 5/1989 | Holtzapple et al. | |
| 7,137,442 | B2 * | 11/2006 | Kawahara | F28D 15/0233 165/104.21 |
| 7,246,655 | B2 | 7/2007 | Mochizuki et al. | |
| 7,520,315 | B2 | 4/2009 | Hou et al. | |

(Continued)

FOREIGN PATENT DOCUMENTS

| | | | |
|---|---|---|---|
| JP | H10274487 | A | 10/1998 |
| JP | 2003078091 | A | 3/2003 |

(Continued)

OTHER PUBLICATIONS

English translation of Decision of Dismissal of Amendment for JP Application No. 2018-013079, dated Feb. 17, 2021, pp. all.

(Continued)

*Primary Examiner* — Tho V Duong
(74) *Attorney, Agent, or Firm* — Dorsey & Whitney LLP

(57) ABSTRACT

Provided is a heat pipe which is installed in a cold region in a bottom heat posture in which a longitudinal direction of a container is substantially in parallel with a gravitational direction, is capable of preventing the container from deforming even when a working fluid has become frozen, and has excellent heat transport properties.

5 Claims, 5 Drawing Sheets

(56) References Cited

U.S. PATENT DOCUMENTS

| | | | | |
|---|---|---|---|---|
| 8,590,601 | B2 * | 11/2013 | Lee | F28D 15/046 165/104.26 |
| 2003/0141045 | A1 | 7/2003 | Oh et al. | |
| 2006/0162906 | A1 | 7/2006 | Hong et al. | |
| 2006/0175044 | A1 * | 8/2006 | Lee | F28F 13/185 257/E23.088 |
| 2006/0207750 | A1 | 9/2006 | Chang et al. | |
| 2006/0283575 | A1 * | 12/2006 | Pai | F28D 15/046 165/104.26 |
| 2007/0240858 | A1 | 10/2007 | Hou et al. | |
| 2007/0240859 | A1 | 10/2007 | Wang et al. | |
| 2007/0246194 | A1 | 10/2007 | Hou et al. | |
| 2007/0251673 | A1 | 11/2007 | Hou et al. | |
| 2007/0272399 | A1 | 11/2007 | Nitta et al. | |
| 2010/0263833 | A1 * | 10/2010 | Lee | F28D 15/046 165/104.26 |
| 2010/0266864 | A1 * | 10/2010 | Lee | B22F 7/08 428/553 |
| 2011/0297269 | A1 * | 12/2011 | Pilon | F16L 9/02 72/368 |
| 2013/0213611 | A1 * | 8/2013 | Wu | F28D 15/0233 165/104.26 |
| 2013/0213612 | A1 | 8/2013 | Wu | |
| 2014/0166246 | A1 | 6/2014 | Dai et al. | |
| 2014/0174085 | A1 | 6/2014 | Kare et al. | |
| 2016/0014931 | A1 * | 1/2016 | Hamakawa | H05K 7/20336 165/104.26 |
| 2017/0122673 | A1 * | 5/2017 | Chin | H01L 23/427 |
| 2020/0041215 | A1 | 2/2020 | Inagaki et al. | |
| 2020/0149823 | A1 | 5/2020 | Kawabata et al. | |

FOREIGN PATENT DOCUMENTS

| | | | |
|---|---|---|---|
| JP | 2003214779 | A | 7/2003 |
| JP | 2007317876 | A | 12/2007 |
| JP | 2015121373 | A | 7/2015 |
| WO | 2014157147 | A1 | 10/2014 |

OTHER PUBLICATIONS

English translation of Decision of Refusal for JP Application No. 2018-013079, dated Feb. 17, 2021, pp. all.

English translation of Decision to Grant for TW Application No. 107112566, dated Oct. 5, 2019, pp. all.

English translation of Notice of Allowance for JP Application No. 2017-079261, dated Feb. 19, 2018, pp. all.

English translation of Notice of Decision for Refusal for JP Application No. 2017-079261, dated Oct. 30, 2017, pp. all.

English translation of Notice of Reason for Rejection for JP Application No. 2017-079261, dated Aug. 14, 2017, pp. all.

English translation of Notice of Reasons for Refusal for JP Application No. 2018-013079, dated Nov. 4, 2020, pp. all.

English translation of Office Action for TW Application No. 107112566, dated Feb. 21, 2019, pp. all.

English translation of the International Preliminary Report on Patentability received in PCT/JP2018/015246, dated Oct. 15, 2019, pp. all.

English translation of the Written Opinion of the International Search Authority received in PCT/JP2018/015246 dated Jul. 10, 2018, pp. all.

International Search Report and Written Opinion received in PCT Application No. PCT/JP2018/015246, dated Jul. 10, 2018 (Engl. Translation of ISR only), pp. all.

* cited by examiner

HEAT PIPE

CROSS REFERENCE TO RELATED APPLICATIONS

The present application is a divisional of U.S. application Ser. No. 16/600,114, filed Oct. 11, 2019 and issued as U.S. Pat. No. 11,415,373 on Aug. 16, 2022, which claims the benefit of Japanese Patent Application No. 2017-079261, filed on Apr. 12, 2017. The contents of these applications, and issued patent, are incorporated herein by reference in their entirety.

BACKGROUND

Technical Field

The present disclosure relates to a heat pipe which has a favorable maximum heat transport amount, further has a small thermal resistance, and has excellent heat transport properties.

Background

In electronic components such as semiconductor devices mounted in electric and electronic apparatuses such as desktop personal computers and servers, due to high-density mounting and the like in conjunction with enhancement in functionality, amounts of heat generation are increased, and cooling therefor has become further crucial. As a cooling method for the electronic components, heat pipes are sometimes used.

In addition, the heat pipes are sometimes installed in cold regions. When the heat pipes are installed in the cold regions, a working fluid sealed in each container is frozen, and the heat pipes may be hindered from smoothly operating. Therefore, it has been proposed that by employing a heat pipe type cooler in which an amount of the working fluid in at least one heat pipe among a plurality of heat pipes is set to 35% to 65% of an amount of the working fluid in each of the other heat pipes, when the working fluid has become frozen, first, the working fluid in the at least one heat pipe having the small amount of the working fluid and having a small heat capacity is first melted, and thus, a time required for starting-up is shortened (Japanese Patent Application Laid-Open No. 10-274487).

However, even by employing Japanese Patent Application Laid-Open No. 10-274487, the working fluid is still easily frozen in the cold regions, thereby sometimes leading to a problem in that upon freezing of the working fluid, a volume of the working fluid expands and the container is thus deformed and destroyed. In addition, the container is deformed, thereby leading to a problem in that the deformed container collides with and damages other members such as a liquid crystal and a battery disposed around the heat pipes. Further, each of the heat pipes has a narrow and small clearance inside the container, thereby leading to a problem in that volume expansion caused by the freezing of the working fluid may make the deformation and destruction of the container more remarkable.

In addition, in the cold regions, each of the heat pipes is sometimes installed in a bottom heat state in which a longitudinal direction of the container is substantially in parallel with a gravitational direction. When each of the heat pipes is installed in the bottom heat posture, in particular, with each of the heat pipes being in a non-operational state, the working fluid in a liquid phase is retained in a bottom of the container. In the cold regions, the working fluid in the liquid phase retained in the bottom of the container is frozen and the volume of the working fluid expands, thereby leading to a problem in that a frequency of the deformation and destruction of the container is further increased. In addition, a non-freezing solution is used in order to prevent the working fluid from freezing or a wall thickness of the container is made thicker in order to prevent the container from deforming and being destroyed due to the freezing of the working fluid, leading to a problem in that heat transport properties of each of the heat pipes are reduced.

SUMMARY

The present disclosure is related to providing a heat pipe which is installed in a cold region in a bottom heat posture in which a longitudinal direction of a container is substantially in parallel with a gravitational direction, is capable of preventing the container from deforming even when a working fluid is frozen, and has excellent heat transport properties.

In accordance with one aspect of the present disclosure, a heat pipe includes: a container being of a tubular shape and having an inner wall surface, an end surface of one end part of the container and an end surface of another end part of the container being sealed, a groove part being formed on the inner wall surface of the container; a sintered body layer being provided on an inner wall surface of the one end part of the container and being formed by sintering a powder; and a working fluid sealed in a hollow part of the container, the sintered body layer has a first sintered part being located on a side of the end surface of the one end part and a second sintered part being continuous with the first sintered part and being located on a side of the other end part, and an average primary particle diameter of a first powder being a raw material of the first sintered part is smaller than an average primary particle diameter of a second powder being a raw material of the second sintered part.

In the above-described aspect, the sintered body layer is provided in at least one end part of the inner wall surface of the container. In addition, in the inner wall surface of the container, a portion in which the groove part is exposed and a portion which is covered by the sintered body layer are provided. In the sintered body layer having the first sintered part and the second sintered part, boundary parts with the first sintered part and the second sintered part are formed. In addition, since the average primary particle diameter of the first powder being the raw material of the first sintered part is smaller than the average primary particle diameter of the second powder being the raw material of the second sintered part, a capillary force of the first sintered part is larger than a capillary force of the second sintered part, and a flow path resistance inside the second sintered part against the working fluid in a liquid phase is smaller than a flow path resistance inside the first sintered part against the working fluid in the liquid phase.

In addition, in the above-described aspect, the heat pipe is installed in a bottom heat posture in which the longitudinal direction of the container is substantially in parallel with the gravitational direction. When in the one end part of the container, which is provided with the sintered body layer, a portion corresponding to the first sintered part is caused to function as a heat receiving part and the other end part is caused to function as a heat dissipation part, the working fluid in the liquid phase refluxed from the heat dissipation part to the end surface of the one end part of the container and the vicinity of the end surface of the one end part is smoothly diffused, due to capillary action of the first sintered part having the relatively large capillary force, inside the first sintered part from the end surface of the one end part and the vicinity of the end surface of the one end part to a direction of the second sintered part (direction substantially opposite to the gravitational direction). The working fluid in the liquid phase which has been diffused inside the first sintered part receives heat from a cooled target and phase-changes from the liquid phase to a gas phase. The working fluid which has phase-changed from the liquid phase to the gas phase circulates from the heat receiving part to the heat dissipation part and releases latent heat at the heat dissipation part. The working fluid which has released the latent heat and phase-changed from the gas phase to the liquid phase is refluxed by a capillary force of the groove part and a gravitational force, from the heat dissipation part of the container to the end surface of the one end part and the vicinity of the end surface of the one end part. In addition, with the heat pipe being in a non-operational state, the working fluid in the liquid phase refluxed to the end surface of the one end part of the container and the vicinity of the end surface of the one end part does not liquid-pool on the end surface of the one end part and in the vicinity of the end surface of the one end part and is smoothly diffused inside the first sintered part to the direction of the second sintered part (direction substantially opposite to the gravitational direction). Further, the working fluid diffused from the inside of the first sintered part to the inside of the second sintered part is diffused inside the second sintered part at a higher diffusion speed than a diffusion speed inside the first sintered part. Accordingly, with the heat pipe being in the non-operational state, the working fluid in the liquid phase is smoothly diffused inside the second sintered part.

In accordance with another aspect of the present disclosure, a heat pipe includes: a container being of a tubular shape and having an inner wall surface, an end surface of one end part of the container and an end surface of another end part of the container being sealed, a groove part being formed on the inner wall surface of the container; a sintered body layer being provided on an inner wall surface of a central part of the container in a longitudinal direction and being formed by sintering a powder; and a working fluid sealed in a hollow part of the container, the sintered body layer has a first sintered part being located in a central part of the sintered body layer and a second sintered part being continuous with the first sintered part and being located on each of both end parts of the sintered body layer, and an average primary particle diameter of a first powder being a raw material of the first sintered part is smaller than an average primary particle diameter of a second powder being a raw material of the second sintered part.

In the aspect of the present disclosure, a ratio of the average primary particle diameter of the first powder to the average primary particle diameter of the second powder is 0.3 to 0.9.

In the aspect of the present disclosure, a protruding sintered body is further provided, the protruding sintered body protruding from the sintered body layer in a cross section perpendicular to the longitudinal direction of the container and being formed by sintering a powder.

In the aspect of the present disclosure, a wall thickness (T1) of the container in a bottom portion of the groove part divided by a thickness (T2) of the sintered body layer on a top portion of the groove part is 0.30 to 0.80.

In the aspect of the present disclosure, in the cross section perpendicular to the longitudinal direction of the container, an area (A1) of the sintered body layer divided by an area (A2) of the hollow part is 0.30 to 0.80.

In the aspect of the present disclosure, in the cross section perpendicular to the longitudinal direction of the container, (an area (A1) of the sintered body layer+an area (A3) of the protruding sintered body) divided by an area (A2) of the hollow part is 1.2 to 2.0.

In the aspect of the present disclosure, in the longitudinal direction of the container, a length of the first sintered part divided by a length of the second sintered part is 0.2 to 3.0.

According to the aspect of the present disclosure, the average primary particle diameter of the first powder being the raw material of the first sintered part is smaller than the average primary particle diameter of the second powder being the raw material of the second sintered part. Thus, since the capillary force of the first sintered part is larger than the capillary force of the second sintered part, by causing the first sintered part to function as the heat receiving part, even when the heat pipe is installed in the bottom heat posture in which the longitudinal direction of the container is substantially in parallel with the gravitational direction, drying-out of the working fluid in the liquid phase in the heat receiving part can be surely prevented and excellent heat transport properties can be exhibited. In addition, since the flow path resistance inside the second sintered part against the working fluid in the liquid phase is smaller than the flow path resistance inside the first sintered part against the working fluid in the liquid phase, even with the heat pipe being in the non-operational state, the working fluid in the liquid phase is quickly diffused via the first sintered part inside the second sintered part. Consequently, since even with the heat pipe being in the non-operational state, the working fluid in the liquid phase in the end surface of the one end part of the container, which is provided with the first sintered part, and in the vicinity of the end surface of the one end part can be prevented from liquid-pooling, the working fluid in the liquid phase is inhibited from freezing. In addition, since even when the working fluid in the liquid phase has become frozen in the one end part of the container, local liquid pooling of the working fluid in the liquid phase is prevented, local volume expansion of the working fluid is alleviated and deformation of the container can be prevented. In addition, since even h the heat pipe being in the non-operational state, liquid pooling of the working fluid in the liquid phase in the central part of the container, which is provided with the first sintered part, can be prevented, the working fluid in the liquid phase is inhibited from freezing. Since even when the working fluid in the liquid phase has become frozen in the central part of the container, local liquid pooling of the working fluid in the liquid phase is prevented, local volume expansion of the working fluid is alleviated and deformation of the container can be prevented.

In addition, since it is not required to use a non-freezing solution and a container whose wall thickness is thin can be used, excellent heat transport properties are exhibited.

According to the aspect of the present disclosure, the ratio of the average primary particle diameter of the first powder to the average primary particle diameter of the second powder is 0.3 to 0.9. Thus, reduction performance in the capillary force inside the first sintered part and the flow path resistance inside the second sintered part can be enhanced in a well-balanced manner.

According to the aspect of the present disclosure, since the protruding sintered body protruding from the sintered body layer is further provided, and thus, local liquid pooling of the working fluid in the liquid phase is further reduced, deformation of the container can be more surely prevented.

According to the aspect of the present disclosure, the wall thickness (T1) of the container in the bottom portion of the groove part divided by the thickness (T2) of the sintered body layer on the top portion of the groove part is 0.30 to 0.80, thus surely preventing the working fluid in the liquid phase from liquid-pooling and allowing excellent circulation properties of the working fluid in the gas phase to be obtained.

According to the aspect of the present disclosure, the area (A1) of the sintered body layer divided by the area (A2) of the hollow part is 0.30 to 0.80 and (the area (A1) of the sintered body layer+the area (A3) of the protruding sintered body) divided by the area (A2) of the hollow part is 1.2 to 2.0, thus surely preventing the working fluid in the liquid phase from liquid-pooling and allowing excellent circulation properties of the working fluid in the gas phase to be obtained.

DETAILED DESCRIPTION

Embodiments

Hereinafter, a heat pipe according to a first embodiment of the present disclosure will be described with reference to the accompanying drawings.

Figure 1A:
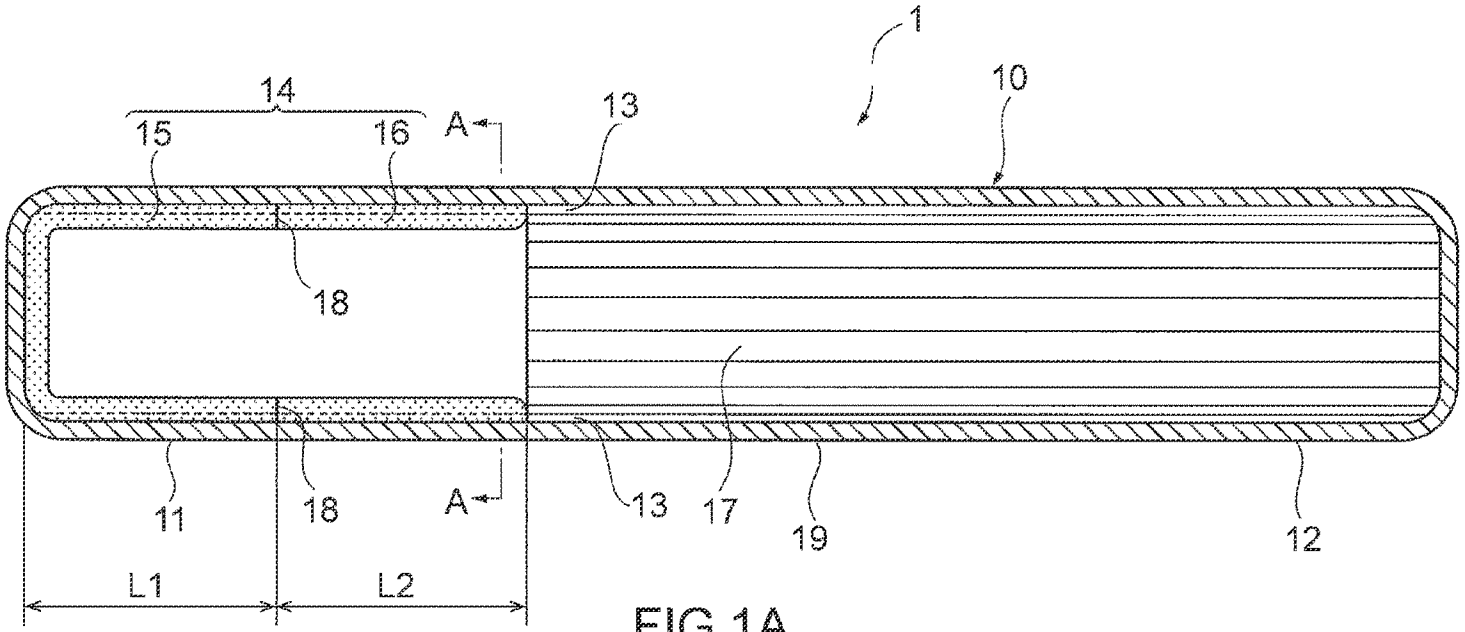
FIG. 1A is a side cross-sectional view of a heat pipe according to a first embodiment of the present disclosure and FIG. 1B is a cross sectional view, taken along arrows A-A in FIG. 1A.

As shown in FIG. 1A, a heat pipe 1 according to the first embodiment includes: a tubular container 10 whose end surfaces of one end part 11 and another end part 12 are sealed; a groove part 13 which is constituted of a plurality of fine grooves formed on an inner wall surface of the container 10 along a longitudinal direction of the container 10; a sintered body layer 14 which is provided on the inner wall surface of the one end part 11 of the container 10 and is formed by sintering a powder; and a working fluid (not shown) sealed in a hollow part 17 of the container 10.

The container 10 is a sealed-up substantially linear tubing material and is substantially circular in a cross-sectional shape in a direction orthogonal to the longitudinal direction (that is, perpendicular to the longitudinal direction). A wall thickness of the container 10 is not particularly limited and for example, is 50 to 1,000 μm. A dimension of the container 10 in a radial direction is not particularly limited and for example, is 5 to 20 mm.

Figure 1B:
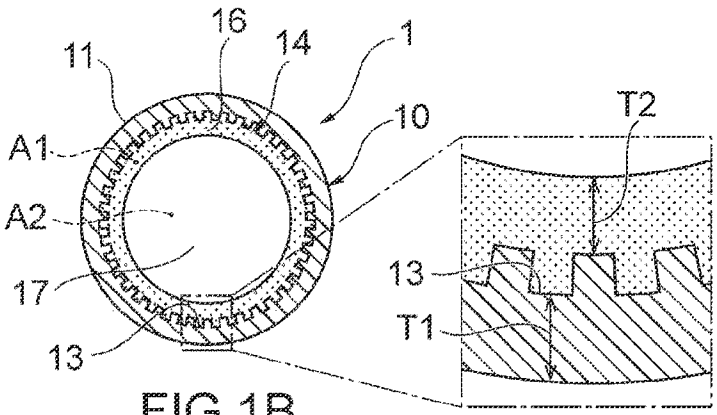

As shown in FIGS. 1A and 1B, on the inner wall surface of the container 10, the groove part 13 constituted of the plurality of fine grooves, that is, grooves are formed along the longitudinal direction of the container 10 from the one end part 11 to the other end part 12, In addition, the groove part 13 is formed on the whole inner peripheral surface of the container 10.

On the one end part 11 of the inner wall surface of the container 10 where the groove part 13 is formed, a sintered body layer 14 formed by sintering the powder is provided. The sintered body layer 14 is formed on the whole inner peripheral surface of the container 10. Accordingly, on an inner wall surface of the one end part 11, the groove part 13 is covered by the sintered body layer 14. Note that in the heat pipe 1, the other end part 12 and a central part 19 of the container 10 are not provided with the sintered body layer 14. Therefore, in the other end part 12 and the central part 19 of the container 10, the groove part 13 is exposed to an inside space (the hollow part 17) of the container 10.

In addition, the sintered body layer 14 has a first sintered part 15 being adjacent to the end surface of the one end part 11 and a second sintered part 16 being continuous with the first sintered part 15 and located on a side of the other end part 12. In a border between the first sintered part 15 and the second sintered part 16, a boundary part 18 is formed. Note that in the heat pipe 1, also on the end surface of the one end part 11, the first sintered part 15 is provided.

The first sintered part 15 is a sintered body formed of a first powder and the second sintered part 16 is a sintered body formed of a second powder. An average primary particle diameter of the first powder which is a raw material of the first sintered part 15 is smaller than an average primary particle diameter of the second powder which is a raw material of the second sintered part 16. Accordingly, an average value of cross-sectional areas of respective gaps formed inside the second sintered part 16 is larger than an average value of cross-sectional areas of respective gaps formed inside the first sintered part 15. In other words, since the average primary particle diameter of the first powder is smaller than the average primary particle diameter of the second powder, a capillary force of the first sintered part 15 is larger than a capillary force of the second sintered part 16, and a flow path resistance of the working fluid in a liquid phase inside the second sintered part 16 is smaller than a flow path resistance of the working fluid in the liquid phase inside the first sintered part 15.

A ratio of the average primary particle diameter of the first powder to the average primary particle diameter of the second powder is not particularly limited, and in light of reduction in the capillary force inside the first sintered part 15 and the flow path resistance inside the second sintered part 16, it is preferable that the ratio is 0.3 to 0.9 and it is particularly preferable that the ratio is 0.4 to 0.8. In addition, the average primary particle diameter of the first powder and the average primary particle diameter of the second powder are not particularly limited as long as the average primary particle diameter of the first powder is smaller than the average primary particle diameter of the second powder and for example, it is preferable that the average primary particle diameter of the first powder is equal to or greater than 10 μm and less than 90 μm and it is preferable that the average primary particle diameter of the second powder is equal to or greater than 90 μm and equal to or less than 250 μm. For example, by sieving out the powders, the powders in the above-mentioned ranges of the average primary particle diameters can be obtained.

As shown in FIGS. 1A and 1B, an inside space of the container 10 is the hollow part 17, and the hollow part 17 is a steam flow path for the working fluid in a gas phase. In other words, a surface of the sintered body layer 14 in the one end part 11 of the container 10 and an inner wall surface of the container 10, on which the groove part 13 is formed, in the other end part 12 and the central part 19 of the container 10 constitute a wall surface of the steam flow path, respectively.

A value of a wall thickness (T1) of the container 10 in a bottom portion of each of the fine grooves constituting the groove part 13 divided by a thickness (T2) of the sintered body layer 14 on a top portion of each of the fine grooves constituting the groove part is not particularly limited, and in light of secure prevention of liquid pooling of the working fluid in the liquid phase, it is preferable that the value is equal to or greater than 0.30, it is more preferable that the value is equal to or greater than 0.40, and it is particularly preferable that the value is equal to or greater than 0.45. On the other hand, in light of circulation properties of the working fluid in the gas phase, it is preferable that an upper limit of the above-mentioned value of (T1)/(T2) is equal to or less than 0.80.

A value of an area (A1) of the sintered body layer 14 divided by an area (A2) of the hollow part 17 in a cross section perpendicular to the longitudinal direction of the container 10 is not particularly limited, and in light of the secure prevention of the liquid pooling of the working fluid in the liquid phase, it is preferable that the value is equal to or greater than 0.30, it is more preferable that the value is equal to or greater than 0.40, and it is particularly preferable that the value is equal to or greater than 0.45. On the other hand, in light of circulation properties of the working fluid in the gas phase, it is preferable that the above-mentioned value of (A1)/(A2) is equal to or less than 0.80.

A value of a length (L1) of the first sintered part 15 divided by a length (L2) of the second sintered part 16 in the longitudinal direction of the container 10 is not particularly limited, and in light of secure prevention of drying-out of the working fluid in the liquid phase and of the liquid pooling of the working fluid in the one end part 11, it is preferable that the value is 0.2 to 3.0 and it is particularly preferable that the value is 0.7 to 1.7.

A material of the container 10 is not particularly limited and for example, in light of excellent heat conductivity, copper, a copper alloy, and the like, in light of a lightweight property, aluminum, an aluminum alloy, and the like, and in light of enhancement in strength, stainless-steel and the like can be used. Furthermore, in accordance with a usage situation, tin, a tin alloy, titanium, a titanium alloy, nickel, a nickel alloy, and the like may be used. Materials of the first powder and the second powder which are the raw materials of the sintered body layer 14 are not particularly limited and for example, a powder including a metallic powder can be cited, and as a specific example, a metallic powder such as a copper powder and a stainless-steel powder, a mixed powder of the copper powder and a carbon powder, nanoparticles of the above-mentioned powders, and the like can be cited. Accordingly, as the sintered body layer 14, a sintered body of the powder including the metallic powder can be cited, and as a specific example, a sintered body of the metallic powder such as the copper powder and the stainless-steel powder, a sintered body of the mixed powder of the copper powder and the carbon powder, a sintered body of the nanoparticles of the above-mentioned powders, and the like can be cited. The material of the first powder and the material of the second powder may be the same as each other or may be different from each other.

In addition, in accordance with suitability with the material of the container 10, the working fluid sealed in the container 10 can be appropriately selected and for example, water, an alternative for chlorofluorocarbon, perfluorocarbon, cyclopentane, and the like can be cited.

Thereafter, a mechanism of heat transport of the heat pipe 1 according to the first embodiment of the present disclosure will be described. When the heat pipe 1 receives heat from a heating element (not shown) thermally connected at a portion where the first sintered part 15 of the one end part 11 is provided, the portion where the first sintered part 15 of the one end part 11 is provided functions as a heat receiving part, and the working fluid in the heat receiving part phase-changes from the liquid phase to the gas phase. The working fluid which has phase-changed to the gas phase flows through the steam flow path, which is the hollow part 17, from the heat receiving part to a heat dissipation part, which is the other end part 12, in the longitudinal direction of the container 10, and thus, the heat from the heating element is transported from the heat receiving part to the heat dissipation part. Through phase-changing of the working fluid in the gas phase to the liquid phase, the heat from the heating element, which has been transported from the heat receiving part to the heat dissipation part, is released as latent heat at the heat dissipation part provided with a heat exchanger (not shown). The latent heat released in the heat dissipation part is released by the heat exchanger provided for the heat dissipation part from the heat dissipation part to an environment outside the heat pipe 1, The working fluid which has phase-changed to the liquid phase in the heat dissipation part is refluxed by a capillary force of the groove part 13 from the heat dissipation part to the heat receiving part. At this time, since a flow path resistance of the groove part 13 against the working fluid is smaller than a flow path resistance of the sintered body layer 14, the working fluid which has phase-changed to the liquid phase in the heat dissipation part is smoothly refluxed from the heat dissipation part to the heat receiving part.

Since in the heat pipe 1 according to the first embodiment, the average primary particle diameter of the first powder which is the raw material of the first sintered part 15 is smaller than the average primary particle diameter of the second powder which is the raw material of the second sintered part 16, the capillary force of the first sintered part 15 is larger than the capillary force of the second sintered part 16. Thus, by causing the first sintered part 15 to function as the heat receiving part, even when the heat pipe 1 is disposed in a bottom heat posture in which the longitudinal direction of the container 10 is substantially in parallel with a gravitational direction, the working fluid in the liquid phase in the heat receiving part can be surely prevented from drying out and excellent heat transport properties can be exhibited. In addition, since the flow path resistance inside the second sintered part 16 against the working fluid in the liquid phase is smaller than the flow path resistance inside the first sintered part 15 against the working fluid in the liquid phase, even with the heat pipe 1 being in a non-operational state, the working fluid in the liquid phase is quickly diffused from the end surface of the one end part 11 and the vicinity of the end surface of the one end part 11 of the container 10 via the first sintered part 15 to an inside of the second sintered part 16. Thus, since even with the heat pipe 1 being in the non-operational state, the working fluid in the liquid phase on the end surface of the one end part 11 and in the vicinity of the end surface of the one end part 11 of the container 10 can be prevented from liquid-pooling, the working fluid in the liquid phase is inhibited from freezing. In addition, even when the working fluid in the liquid phase has become frozen, since the working fluid in the liquid phase is prevented from locally liquid-pooling (liquid-pooling on the end surface of the one end part 11 and in the vicinity of the end surface of the one end part 11), local volume expansion of the working fluid is alleviated and the deformation of the container 10 can be prevented.

In addition, since in the heat pipe 1, the local volume expansion caused by the freezing of the working fluid is alleviated, it is not required to use a non-freezing solution, and also considering that the container 10 whose wall thickness is thin can be used, excellent heat transport properties are exhibit.

Thereafter, a heat pipe according to a second embodiment of the present disclosure will be described with reference to the drawing. Note that the same components as those in the heat pipe according to the first embodiment will be described by using the same reference signs.

Figure 2:
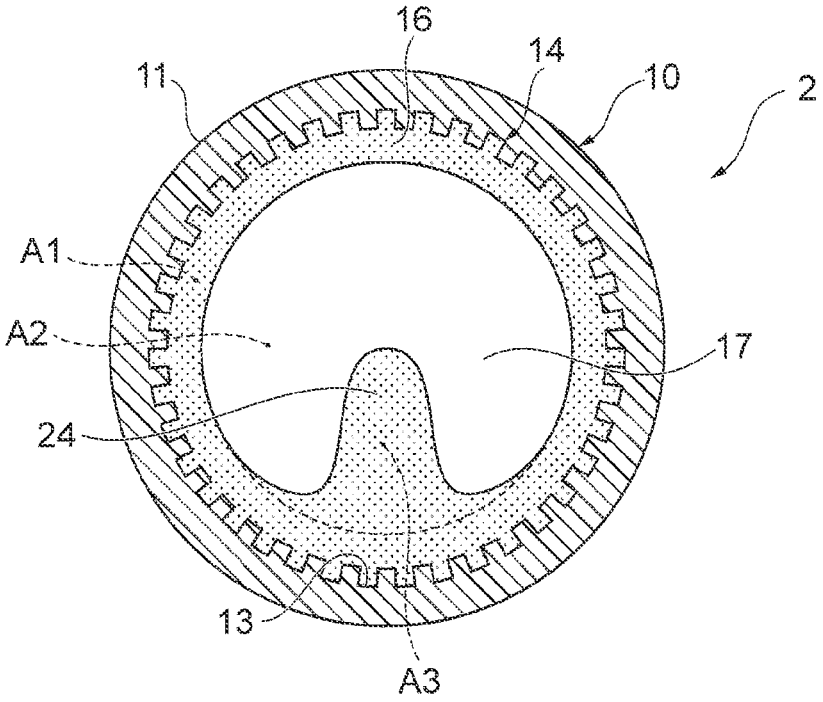
FIG. 2 is a front cross-sectional view of a heat pipe according to a second embodiment of the present disclosure.

As shown in FIG. 2, the heat pipe 2 according to the second embodiment is further provided with a protruding sintered body 24, in a cross section perpendicular to a longitudinal direction of a container 10, which protrudes from a sintered body layer 14 and is formed by sintering a powder. The sintered body layer 14 and the protruding sintered body 24 are configured to be continuous with each other. In the heat pipe 2, one protruding sintered body 24 is provided, and a tip end portion (top portion) of the protruding sintered body 24 is configured not to contact a portion of the sintered body layer 14, which the protruding sintered body 24 faces.

In the heat pipe 2, the protruding sintered body 24 extends from a first sintered part 15 to a second sintered part 16. In other words, the protruding sintered body 24 is provided in the first sintered part 15 and the second sintered part 16. The protruding sintered body 24 in the first sintered part 15 is a sintered body whose raw material is a first powder. The protruding sintered body 24 in the second sintered part 16 is a sintered body whose raw material is a second powder.

In the cross section perpendicular to the longitudinal direction of the container 10, a value of (an area (A1) of the sintered body layer 14+an area (A3) of the protruding sintered body 24) divided by an area (A2) of a hollow part 17 is not particularly limited, and in light of secure prevention of liquid pooling of a working fluid in a liquid phase, it is preferable that the value is equal to or greater than 1.2 and it is particularly preferable that the value is equal to or greater than 1.3. On the other hand, in light of circulation properties of the working fluid in a gas phase, it is preferable that an upper limit of the value of ((A1)+(A3))/(A2) is equal to or less than 2.0.

By further providing the protruding sintered body 24, since the working fluid in the liquid phase is diffused not only to the sintered body layer 14 disposed in the vicinity of an outer periphery of the container 10 but also to the protruding sintered body 24 extending in a direction toward a central portion in the cross section perpendicular to the longitudinal direction of the container 10, local liquid pooling is further reduced and deformation of the container can be further surely prevented.

Thereafter, a heat pipe according to a third embodiment of the present disclosure will be described with reference to the drawing, Note that the same components as those in the heat pipes according to the first and second embodiments will be described by using the same reference signs.

Figure 3:
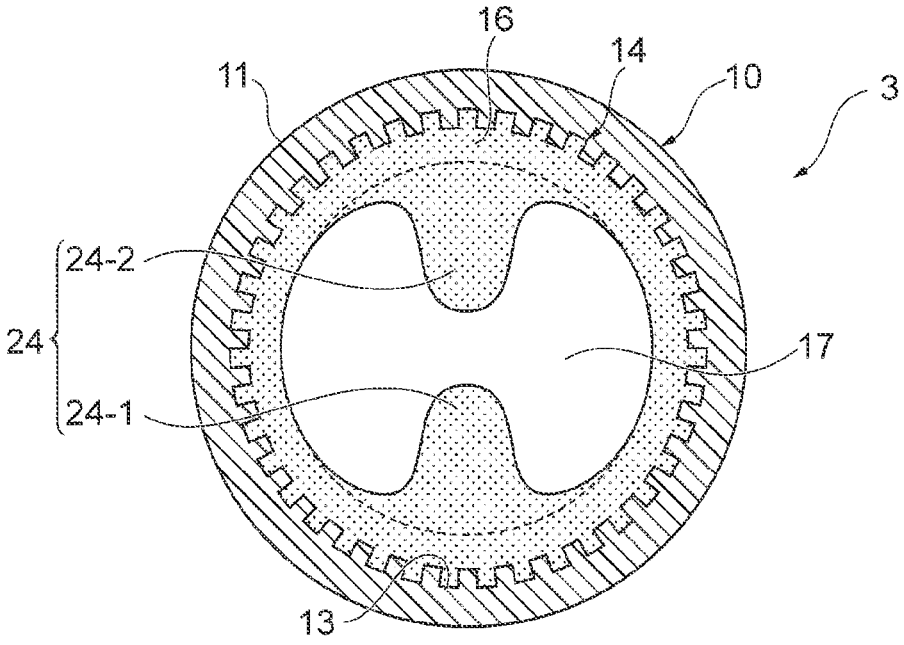
FIG. 3 is a front cross-sectional view of a heat pipe according to a third embodiment of the present disclosure.

In the heat pipe according to the second embodiment, the one protruding sintered body is provided. Instead of this, as shown in FIG. 3, in the heat pipe 3 according to the third embodiment, a plurality of protruding sintered bodies (two protruding sintered bodies in FIG. 3) are provided. In other words, in the heat pipe 3, the protruding sintered bodies 24 are constituted of a first protruding sintered body 24-1 and a second protruding sintered body 24-2 facing the first protruding sintered body 24-1. In the heat pipe 3, the first protruding sintered body 24-1 and the second protruding sintered body 24-2 are configured not to contact each other.

Also in the heat pipe 3, by further providing the protruding sintered bodies 24, since a working fluid in a liquid phase is diffused not only to a sintered body layer 14 disposed in the vicinity of an outer periphery of a container 10 but also to the protruding sintered bodies 24 extending in each direction toward a central portion in a cross section perpendicular to a longitudinal direction of the container 10, local liquid pooling is further reduced and deformation of the container can be further surely prevented.

Thereafter, a heat pipe according to a fourth embodiment of the present disclosure will be described with reference to the drawing. Note that the same components as those in the heat pipes according to the first to third embodiments will be described by using the same reference signs.

Figure 4:
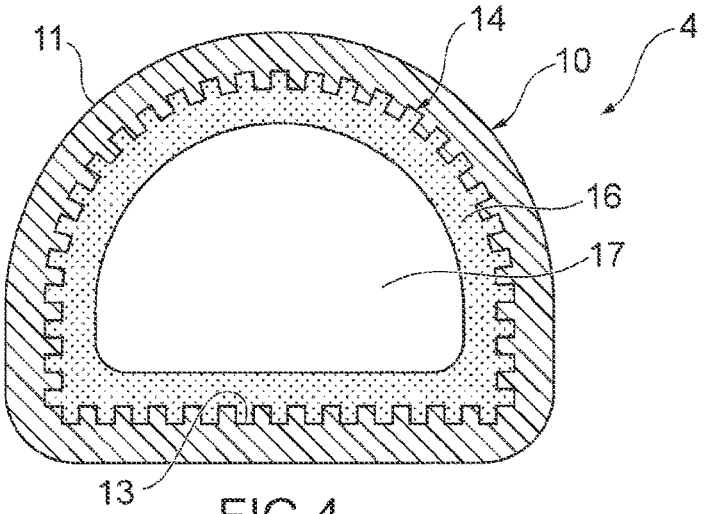
FIG. 4 is a front cross-sectional view of a heat pipe according to a fourth embodiment of the present disclosure.

In the heat pipe according to the first embodiment, the cross-sectional shape in the direction orthogonal to the longitudinal direction of the container is substantially circular. Instead of this, as shown in FIG. 4, in the heat pipe 4 according to the fourth embodiment, a cross-sectional shape in a direction orthogonal to a longitudinal direction of a container 10 is of a flattened shape constituted of a flat portion and a semi-elliptical portion. In other words, the container 10 has been subjected to flattening processing. Also in the heat pipe 4, even with the heat pipe 4 being in a non-operational state, liquid pooling of a working fluid in a liquid phase on an end surface of one end part 11 and in the vicinity of the end surface of one end part 11 of the container 10 can be prevented. In addition, since the container 10 of the heat pipe 4 has the flat portion, thermal connectability with a heating element which is a cooled target is enhanced.

Thereafter, a heat pipe according to a fifth embodiment of the present disclosure will be described with reference to the drawing. Note that the same components as those in the heat pipes according to the first to fourth embodiments will be described by using the same reference signs.

Figure 5:
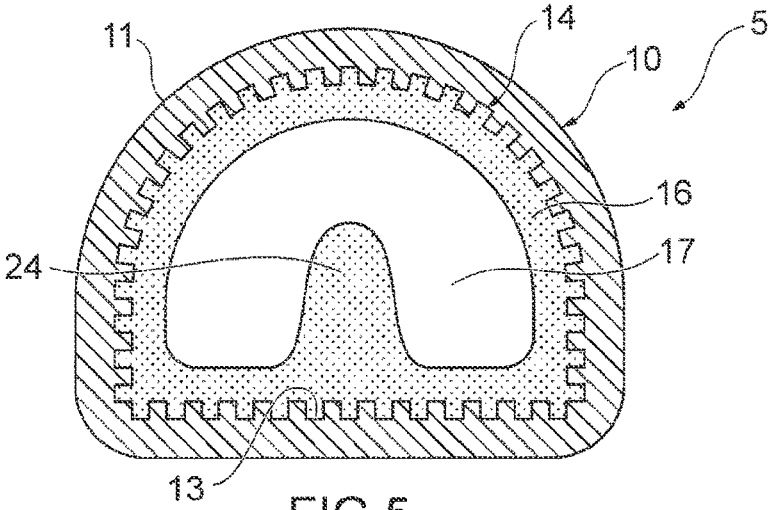
FIG. 5 is a front cross-sectional view of a heat pipe according to a fifth embodiment of the present disclosure.

In the heat pipe according to the second embodiment which is provided with the one protruding sintered body, the cross-sectional shape in the direction orthogonal to the longitudinal direction of the container is substantially circular. Instead of this, as shown in FIG. 5, in the heat pipe 5 according to the fifth embodiment, a cross-sectional shape in a direction orthogonal to a longitudinal direction of a container 10 is of a flattened shape constituted of a flat portion and a semi-elliptical portion. Also in the heat pipe 5, even with the heat pipe 5 being in a non-operational state, liquid-pooling of a working fluid in a liquid phase on an end surface of one end part 11 and in the vicinity of the end surface of one end part 11 of the container 10 can be prevented. In addition, since the container 10 of the heat pipe 5 has the flat portion, thermal connectability with a heating element which is a cooled target is enhanced.

Thereafter, a heat pipe according to a sixth embodiment of the present disclosure will be described with reference to the drawing. Note that the same components as those in the heat pipes according to the first to fifth embodiments will be described by using the same reference signs.

Figure 6:
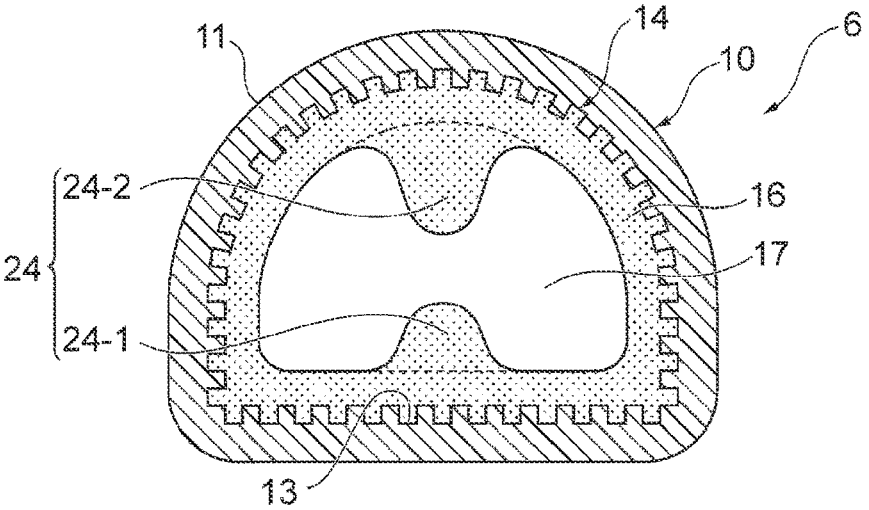
FIG. 6 is a front cross-sectional view of a heat pipe according to a sixth embodiment of the present disclosure.

In the heat pipe according to the third embodiment which is provided with the two protruding sintered bodies, the cross-sectional shape in the direction orthogonal to the longitudinal direction of the container is substantially circular. Instead of this, as shown in FIG. 6, in the heat pipe 6 according to the sixth embodiment, a cross-sectional shape in a direction orthogonal to a longitudinal direction of a container 10 is of a flattened shape constituted of a flat portion and a semi-elliptical portion. Also in the heat pipe 6, even with the heat pipe 6 being in a non-operational state, liquid-pooling of a working fluid in a liquid phase on an end surface of one end part 11 and in the vicinity of the end surface of one end part 11 of the container 10 can be prevented. In addition, since the container 10 of the heat pipe 6 has the flat portion, thermal connectability with a heating element which is a cooled target is enhanced.

Thereafter, a heat pipe according to a seventh embodiment of the present disclosure will be described with reference to the drawing, Note that the same components as those in the heat pipes according to the first to sixth embodiments will be described by using the same reference signs.

Figure 7:
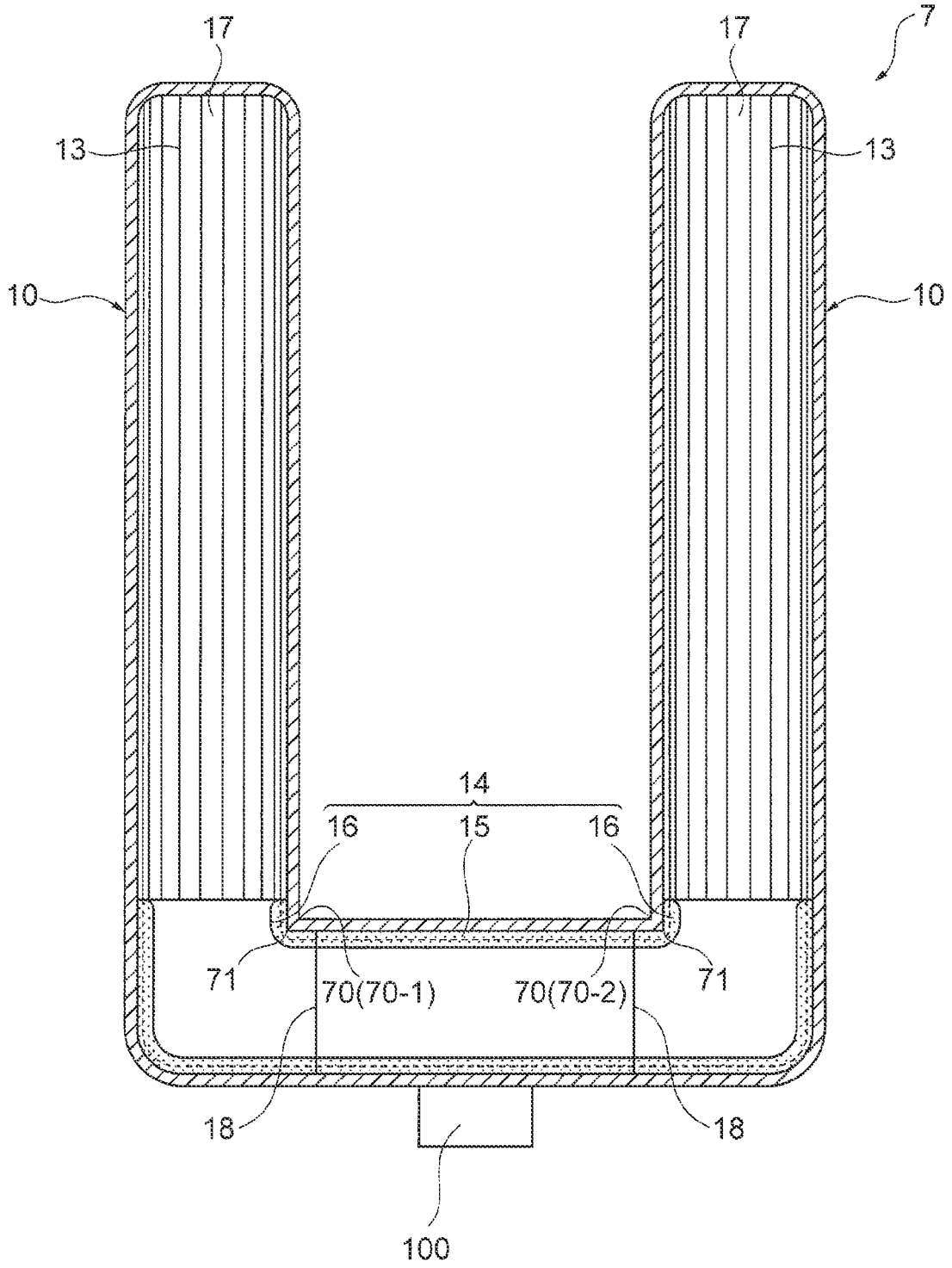
FIG. 7 is a side cross-sectional view of a heat pipe according to a seventh embodiment of the present disclosure.

In each of the above-described embodiments, the sintered body layer is provided in the one end part of the heat pipe. Instead of this, as shown in FIG. 7, in the heat pipe 7 according to the seventh embodiment, in a central part of a container 10 in a longitudinal direction, a sintered body layer 14 is provided, and in both end parts of the container 10 in the longitudinal direction, no sintered body layers 14 are provided. Consequently, in each of both end parts of the container 10, a groove part 13 is exposed to an inside space (hollow part 17) of the container 10. In the heat pipe 7 according to the seventh embodiment, a shape of the container 10 in the longitudinal direction is a substantially U-shape, and two bending parts 70 are formed in the longitudinal direction of the container 10. In the two bending parts 70 (one bending parts 70-1 and another bending parts 70-2) forming the substantially U-shape and in the vicinity of the two bending parts 70, the sintered body layer 14 is provided. Accordingly, in a portion from at least the one bending part 70-1 to the other bending part 70-2, the sintered body layer 14 is provided. In addition, a first sintered part 15 is provided on a central part of the sintered body layer 14 in the longitudinal direction, and second sintered parts 16 continuous with the first sintered part 15 are provided in both end parts of the sintered body layer 14 in the longitudinal direction. In the heat pipe 7, when the central part of the container 10 in the longitudinal direction constitutes a heat receiving part thermally connected with a heating element 100 and both end parts of the container 10 in the longitudinal direction constitute heat dissipation parts, effects similar to the above-described effects are exhibited.

A position of the first sintered part 15 is not particularly limited as long as the first sintered part 15 is located in the central part of the sintered body layer 14 in the longitudinal direction. For example, the first sintered part 15 is provided between the one bending part 70-1 and the other bending part 70-2. Accordingly, between the one bending part 70-1 and the other bending part 70-2, two boundary parts 18, each of which is a border between the first sintered part 15 and each of the second sintered parts 16, are formed.

In addition, the second sintered parts 16 continuous with both ends of the first sintered part 15 extend further in a direction of an end part of the container 10 than the two bending parts 70. In other words, each of the second sintered parts 16 extends in a predetermined length from each of the bending parts 70 of the container 10 in the direction of the end part of the container 10. Accordingly, an inner peripheral surface of each of the two bending parts 70 is covered by each of the second sintered parts 16, respectively.

Unless the sintered body layer 14 is not provided in both end parts of the container 10 in the longitudinal direction, a length of each of the second sintered parts 16, which extends from each of the bending parts 70 of the container 10 in the direction of the end part of the container 10 is not particularly limited. It is preferable that the length of each of the second sintered parts 16 of the bending parts 70 of the container 10, which extends from each of inside bending portions 71 shown in FIG. 7 in the direction of the end part of the container 10, is, for example, 0.20 time to 5.0 times as long as an external diameter of the container 10, and it is particularly preferable that the length is 0.5 time to 2.0 times as long as the external diameter of the container 10. The length of each of the second sintered parts 16, which extends from each of the inside bending portions 71 of the container 10 in the direction of the end part of the container 10 is in the above-mentioned range, thus surely preventing liquid-pooling of a working fluid in a liquid phase in the central part of the container 10 in the longitudinal direction, even with the heat pipe 7 being in a non-operational state. At the same time, a groove part 13 having a small flow path resistance is sufficiently ensured in each of both end parts of the container 10 in the longitudinal direction, thus allowing the working fluid, which has phase-changed from a gas phase to the liquid phase in both end parts of the container 10 in the longitudinal direction, to be further smoothly refluxed to the central part of the container 10 in the longitudinal direction.

Thereafter, an example of a method for manufacturing a heat pipe of the present disclosure will be described. First, an example of a method for manufacturing a heat pipe according to the first embodiment will be described. The method for manufacturing the heat pipe is not particularly limited. For example, a core rod having a predetermined shape is inserted to one end part of a circular tubing material whose inner wall surface is provided with a groove part formed in a longitudinal direction of the heat pipe according to the first embodiment, A gap portion formed between the inner wall surface of the tubing material and an outer surface of the core rod is sequentially filled with a first powder which is a raw material of a first sintered part and a second powder which is a raw material of a second sintered part. Thereafter, by heat-treating the tubing material which is filled with the first powder and the second powder and pulling out the core rod from the tubing material, the heat pipe having the first sintered part and the second sintered part in the one end part can be manufactured.

In addition, a heat pipe provided with a protruding sintered body can be manufactured by inserting a core rod having a predetermined cutout portion to a tubing material, sequentially filling not only a gap portion formed between an inner wall surface of the tubing material and an outer surface of the core rod but also a gap portion formed between the inner wall surface of the tubing material and the cutout portion with a first powder which is a raw material of a first sintered part and a second powder which is a raw material of a second sintered part, and thereafter, heat-treating the tubing material.

Figure 8:
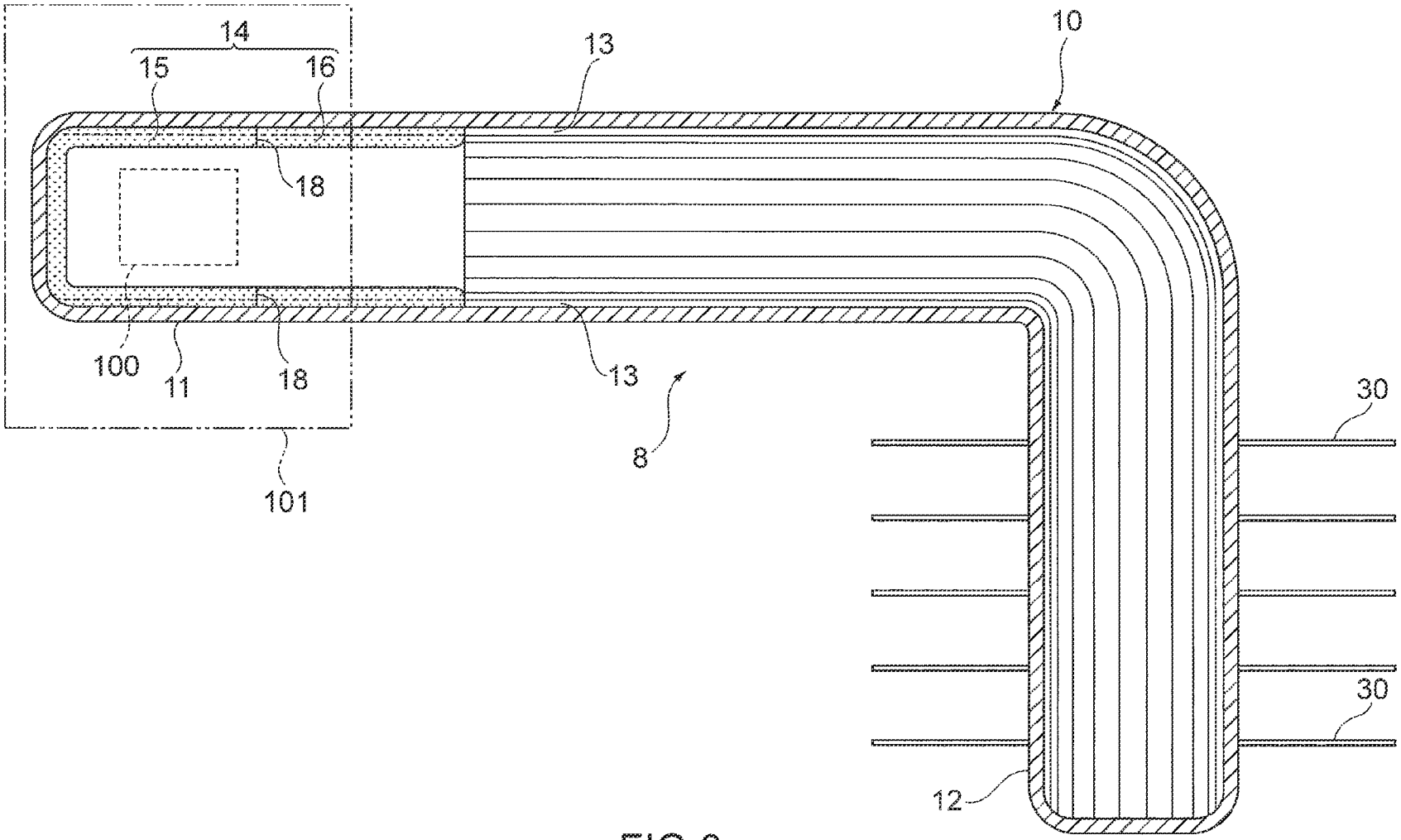
FIG. 8 is a diagram illustrating an example of a usage method of a heat pipe according to an embodiment of the present disclosure.

Thereafter, an example of a usage method of a heat pipe of the present disclosure will be described. Here, instead of the heat pipe 1 according to the first embodiment in which a shape of the container 10 in the longitudinal direction is substantially linear, as shown in FIG. 8, by using a heat pipe 8 in which a container 10 having a substantially L-shape in a longitudinal direction is used and another end part 12 is further provided with a plurality of heat dissipation fins 30 (a heat sink), the example of the usage method will be described.

For cooling of a heating element with the heat pipe 8, for example, by setting a dimension of a first sintered part 15 in a longitudinal direction of a container 10 to be a dimension from one end part 11 of the container 10 to an end of a heating element 100 on a side of the other end part 12 or, if the dimension from the one end part 11 of the container 10 runs beyond the end of the heating element 100 on the side of the other end part 12, to be a dimension of up to 10% to 50% of a dimension of the heating element 100 in the longitudinal direction of the container 10, effects to prevent a working fluid in a liquid phase from liquid-pooling and effects to transport heat can be more efficiently exhibited. In addition, when the heat pipe 8 is thermally connected with the heating element 100 via a heat receiving plate 101, by setting a dimension of a sintered body layer 14 so as to cause at least one part of a second sintered part 16 to cover a heat receiving plate 101 in the longitudinal direction of the container 10, the effects to prevent the working fluid in the liquid phase from liquid-pooling and effects to transport the heat can be more efficiently exhibited.

Thereafter, a heat pipe according to other embodiment of the present disclosure will be described. In the heat pipe according to each of the above-described first to sixth embodiments, the sintered body layer is provided only in the one end part of the container. Instead of this, the sintered body layer may be configured to extend from the one end part to a central part of the container. In addition, in the heat pipe according to each of the above-described first to sixth embodiments, the shape of the container in the longitudinal direction is substantially linear. The shape is not particularly limited and for example, the shape may be a shape having a bending portion such as a U-shape and an L-shape.

In the heat pipe according to each of the above-described third and sixth embodiments, the first protruding sintered body and the second protruding sintered body do not contact each other, Instead of this, top portions (tip end portions) of the first protruding sintered body and the second protruding sintered body may be configured to contact each other. In this case, steam flow paths [hollow parts] are formed on both sides of a protruding sintered body one-by-one. In addition, in the heat pipe according to each of the above-described second, third, fifth, and sixth embodiments, the protruding sintered body extends from the first sintered part to the second sintered part. Instead of this, the protruding sintered body may be provided only in the second sintered part.

EXAMPLES

Thereafter, examples of the present disclosure will be described. However, without departing from the gist of the present disclosure, the present disclosure is not limited to these examples.

Examples 1 to 3

As a heat pipe, the heat pipe according to the first embodiment shown in FIG. 1 was used. As a first powder which was a raw material of a first sintered part (with a length of 20 mm), a copper powder whose average primary particle diameter was 75 μm and as a second powder which was a raw material of a second sintered part (with a length of 25 mm), a copper powder whose average primary particle diameter was 140 μm were used. As a container, a tubing material (formed of stainless-steel) which had a length of 200 mm and whose cross section was circular was used. As a working fluid sealed in the container, water was used. The above-mentioned heat pipe was installed such that a longitudinal direction of the heat pipe was in a vertical direction and a sintered body layer was on a side of a gravitational direction, was subjected to a heat shock test initially at −40° C. for 23 minutes and next at 85° C. for 23 minutes, and thereafter, each ratio at which no deformation in a container shape was visually observed was measured as an OK ratio (%).

Example 4

As a heat pipe, instead of the heat pipe according to the first embodiment shown in FIG. 1, a heat pipe according to the second embodiment shown in FIG. 2 was used. Except for that, conditions in Example 4 were similar to the conditions in each of Examples 1 to 3.

Comparative Examples 1 to 3

As a raw material powder of a second sintered part, instead of the second powder, the first powder was used. Except for that, conditions in each of Comparative Examples 1 to 3 were similar to the conditions in each of Examples 1 to 3.

Specific test conditions and test results in each of Examples and each of Comparative Examples are shown in below Table 1.

TABLE 1

| | HOLLOWPART DIAMETER [mm] | T1 [mm] | T2 [mm] | T1/T2 | A2 [mm2] | A1 [mm2] | A1/A2 | SINTERED PART | HEAT SHOCK OK RATIO (50 CYCLES) | HEAT SHOCK OK RATIO (100 CYCLES) |
|---|---|---|---|---|---|---|---|---|---|---|
| COMPARATIVE EXAMPLE 1 | 5.6 | 0.3 | 0.64 | 47% | 24.63 | 16.789 | 68% | ONE KIND | 50 | 10 |
| COMPARATIVE EXAMPLE 2 | 5.8 | 0.3 | 0.54 | 56% | 26.42 | 14.999 | 57% | ONE KIND | 50 | 10 |
| COMPARATIVE EXAMPLE 3 | 6.0 | 0.3 | 0.44 | 88% | 28.27 | 13.145 | 46% | ONE KIND | 30 | 10 |
| EXAMPLE 1 | 5.6 | 0.3 | 0.64 | 47% | 24.63 | 17.039 | 69% | TWO KINDS | 100 | 100 |

TABLE 1-continued

| | | | | | | | | | | |
|---|---|---|---|---|---|---|---|---|---|---|
| EXAMPLE 2 | 5.8 | 0.3 | 0.64 | 56% | 26.42 | 15.248 | 58% | TWO KINDS | 100 | 100 |
| EXAMPLE 3 | 6.0 | 0.3 | 0.44 | 68% | 28.27 | 13.395 | 47% | TWO KINDS | 90 | 70 |
| | HOLLOWPART DIAMETER [mm] | T1 [mm] | T2 [mm] | T1/T2 | A2 [mm2] | A1 + A3 [mm2) | (A1 + A3)/A2 | | HEAT SHOCK OK RATIO (50 CYCLES) | HEAT SHOCK OK RATIO (100 CYCLES) |
| EXAMPLE 4 | 5.8 | 0.3 | 0.54 | 56% | 14.15 | 22.618 | 160% | TWO KINDS | 100 | 100 |

As is seen from Table 1, in each of Examples 1 to 4 in which as the sintered body layer, two kinds of sintered parts which are the first sintered part and the second sintered part were provided, even with 100 cycles, an excellent heat shock OK ratio was obtained. In particular, in each of Examples 1 and 2 in which a value of T1/T2 was 47% to 56% (0.47 to 0.56) and a value of A1/A2 was 58% to 69% (0.58 to 0.69), as compared with Example 3 in which a value of T1/T2 was 68% (0.68) and a value of A1/A2 was 47% (0.47), a heat shock OK ratio was further enhanced.

On the other hand, in each of Comparative Examples 1 to 3 in which the second sintered part was not provided and one kind of a sintered part was formed, although values of T1/T2 and A1/A2 were substantially the same as the values of T1/T2 and A1/A2 in each of Examples 1 to 3, respectively, even with 50 cycles, no favorable heat shock OK ratio was obtained.

The heat pipe of the present disclosure is installed in a bottom heat posture in which a longitudinal direction of a container is substantially in parallel with a gravitational direction, is capable of preventing the container from deforming even when a working fluid has become frozen, and also exhibits excellent heat transport properties. Hence, a utility value of the heat pipe of the present disclosure is high, for example, in fields where the heat pipes are used in cold regions.

What is claimed is:

1. A heat pipe comprising:

a container being of a tubular shape and having an inner wall surface, an end surface of one end part of the container and an end surface of another end part of the container being sealed, a groove part being formed on the inner wall surface of the container;

a sintered body layer being provided on an inner wall surface of the one end part of the container and being formed by sintering a powder; and a working fluid sealed in a hollow part of the container, wherein the sintered body layer has a first sintered part being located on a side of the end surface of the one end part and a second sintered part being continuous with the first sintered part and being located on a side of the other end part, wherein an average primary particle diameter of a first powder being a raw material of the first sintered part is smaller than an average primary particle diameter of a second powder being a raw material of the second sintered part, wherein a protruding sintered body is further provided, the protruding sintered body protruding from the sintered body layer in a cross section perpendicular to the longitudinal direction of the container and being formed by sintering a powder, and wherein in the cross section perpendicular to the longitudinal direction of the container, (an area (A1) of the sintered body layer+an area (A3) of the protruding sintered body) divided by an area (A2) of the hollow part is 1.2 to 2.0.

2. The heat pipe according to claim 1, wherein in the longitudinal direction of the container, a length of the first sintered part divided by a length of the second sintered part is 0.2 to 3.0.

3. The heat pipe according to claim 1, wherein a ratio of the average primary particle diameter of the first powder to the average primary particle diameter of the second powder is 0.3 to 0.9.

4. The heat pipe according to claim 1, wherein a wall thickness (T1) of the container in a bottom portion of the groove part divided by a thickness (T2) of the sintered body layer on a top portion of the groove part is 0.30 to 0.80.

5. The heat pipe according to claim 1, wherein in the cross section perpendicular to the longitudinal direction of the container, an area (A1) of the sintered body layer divided by an area (A2) of the hollow part is 0.30 to 0.80.

* * * * *